United States Patent [19]

Oury

[11] 4,262,696

[45] Apr. 21, 1981

[54] SWIVEL ARM CONCRETE PLACER

[75] Inventor: Robert F. Oury, Hampshire, Ill.

[73] Assignee: Rotec Industries, Inc., Elmhurst, Ill.

[21] Appl. No.: 112,257

[22] Filed: Jan. 15, 1980

Related U.S. Application Data

[63] Continuation of Ser. No. 906,315, May 16, 1978, abandoned.

[51] Int. Cl.[3] ..... B67D 5/60; B67D 5/64

[52] U.S. Cl. ..... 137/615; 141/232

[58] Field of Search ..... 137/615; 141/232, 231; 222/527; 22/533

[56] References Cited

U.S. PATENT DOCUMENTS

| | | | |
|---|---|---|---|
| 2,948,306 | 8/1960 | Kuraeff | 141/231 |
| 3,014,494 | 12/1961 | Scott et al. | 137/561 R |
| 3,114,392 | 12/1963 | Harper | 137/615 |
| 3,176,730 | 4/1965 | Knight | 141/290 |
| 3,199,898 | 8/1965 | Faccou | 285/41 |
| 3,439,700 | 4/1969 | Prestor | 137/351 |
| 3,451,427 | 6/1969 | Dollinger | 137/615 |
| 3,459,222 | 8/1969 | McElroy | 137/615 |
| 3,605,824 | 9/1971 | Madden et al. | 141/1 |

*Primary Examiner*—Martin P. Schwadron
*Assistant Examiner*—A. Michael Chambers
*Attorney, Agent, or Firm*—Allegretti, Newitt, Witcoff & McAndrews

[57] ABSTRACT

A concrete placing boom device includes a rail-mounted base, extensible outriggers and a jointed two-section cantilevered arm structure that supports a jointed two-section pipeline. Preferably, the inner arm section is pivotally mounted on the base for rotation about a vertical axis and the outer arm section is pivotally mounted on the inner arm section for rotation and angular elevation. The device is joined with pins for assembly and disassembly for easy transport.

6 Claims, 3 Drawing Figures

SWIVEL ARM CONCRETE PLACER

This is a continuation of application Ser. No. 906,315, filed May 16, 1978 now abandoned.

BACKGROUND OF THE INVENTION

This invention relates to a device for transporting a semi-fluid mass such as concrete mix and more particularly, to a concrete placing boom device.

In the past, a variety of equipment for distributing concrete mix has been developed. Buckets of concrete mix have been lifted by cranes, and concrete mix has been distributed by conveyor systems such as those disclosed in U.S. Pat. No. 3,343,651, U.S. Pat. No. Re. 29,110 and U.S. Pat. No. Re. 26,298. A primary goal of such equipment is to transport concrete mix rapidly and continuously into a concrete pour area, with accurate placement, so that a unified and strong concrete structure may be poured.

Recently, concrete pumps have been employed to pump concrete mix through pipelines into concrete pour areas. Utilized with such pumps and pipelines are boom devices. Generally, concrete placing boom devices have been mounted on concrete mixing trucks that are positioned adjacent concrete pour areas. While such devices are useful, the trucks are incapable of traveling directly into some concrete pour areas during pouring, because of the reinforcing steel used in the pour area. The use of the booms is thus limited, because when the concrete pour area is large, the boom cannot reach far enough into the concrete pour area to distribute concrete mix to the center thereof. A further disadvantage of many truck-mounted boom devices is that they elevate concrete mix to heights of fifty feet or more before moving or placing the mix the desired horizontal distances. They thus unnecessarily expend large amounts of energy elevating the concrete mix.

Unfortunately, concrete conveyor devices are not readily convertible to utilization with concrete piping and concrete pumps. This is because concrete flowing inside a pipeline creates high magnitude stresses on joints and bearings, above and beyond those stresses encountered in conveyor systems.

SUMMARY OF THE INVENTION

While the concrete boom devices just described have been useful, it is a principal object of the present invention to provide an improved concrete placing boom device that is substantially free of the limitations and disadvantages of prior art devices.

Another object is to provide a concrete placing boom device that is capable of traveling into a concrete pour area.

Still another object is to provide a concrete placing boom device that minimizes the energy necessary to place the concrete mix.

A further object is to provide a concrete placing boom device that is readily assembled and disassembled for transport.

A further object is to provide a concrete placing boom device that is capable of operating in areas of low headroom.

A further object is to provide a concrete placing boom device that readily places concrete mix around obstructions.

A still further object is to provide a concrete placing boom device that is commercially economical to manufacture.

These and other objects are satisfied by the present invention, which, in a principal aspect, is a device for placing concrete mix from a pipe into a concrete pour area comprising a traveling base member; a free-standing arm structure including an upper arm section and an outer arm section; means for piping the concrete mix including an inner arm piping section and an outer arm piping section having a discharge end, and means for stabilizing the base member and arm structure including at least one outrigger member mounted on the base member.

The inner arm section is pivotally mounted on the base member and supports the inner arm piping section. The outer arm section is pivotally mounted on the inner arm section and supports the outer arm piping section. The inner arm piping section and the outer arm piping section are pivotally connected to each other. The device thus may be located in or adjacent to a concrete pour area and concrete mix may be placed therein by pivoting the arm structure into position so that the discharge end of the outer arm piping section is above the desired pour location.

BRIEF DESCRIPTION OF THE DRAWING

The preferred embodiment of the present invention will be described in connection with the drawing wherein.

DETAILED DESCRIPTION OF THE PREFERRED EMBODIMENT

Figure 1:
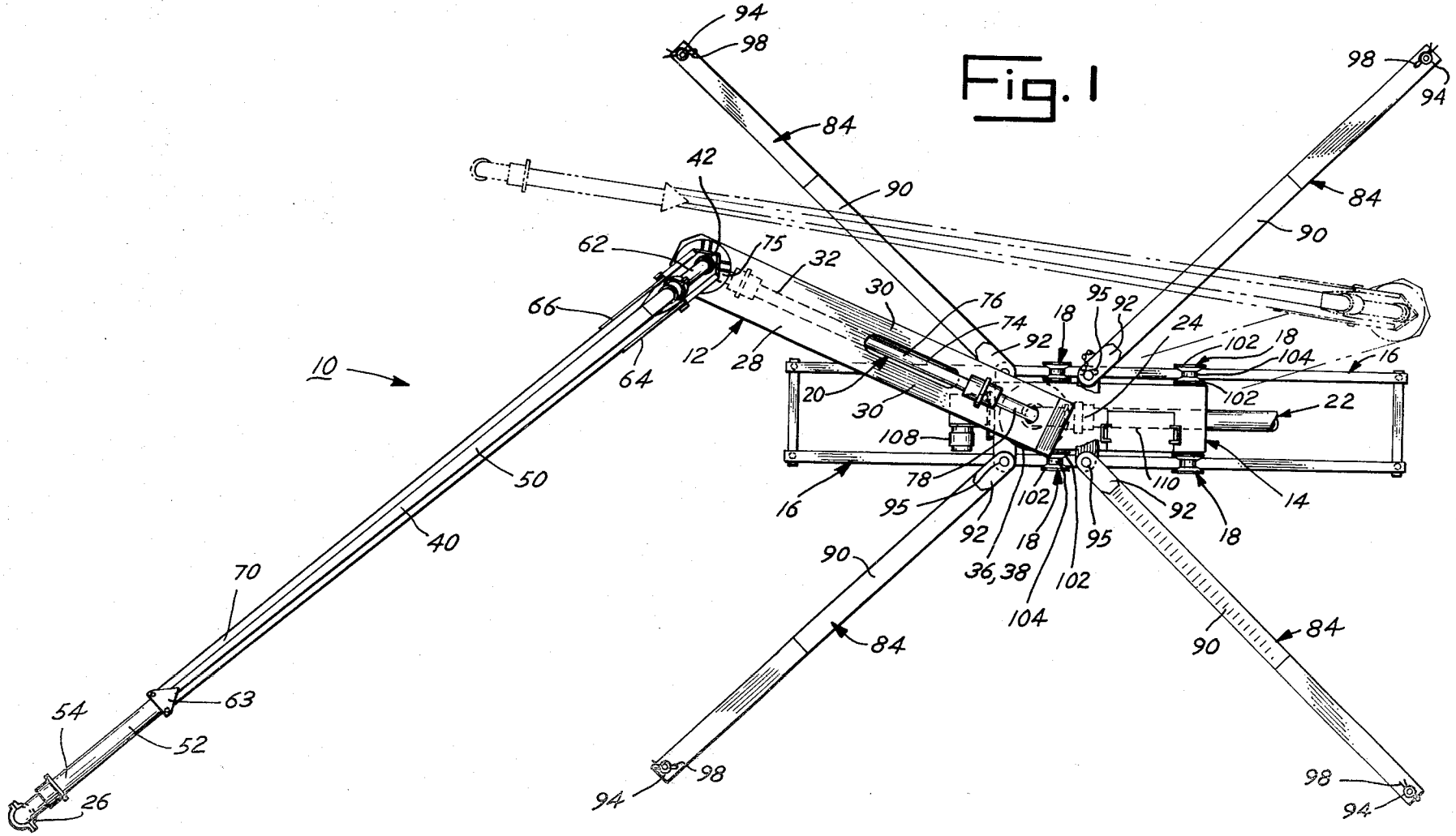
FIG. 1 is a top plan view of the preferred embodiment of the present invention.

Referring to FIG. 1, the preferred embodiment of the present invention is a swivel arm concrete placer 10 having a two-section arm structure 12. A base or arm carrier 14, upon which the arm structure 12 is mounted, travels along rails 16 over wheels 18. A piping system 20 is supported by the arm structure 12 and swivels therewith. Concrete mix is pumped by a concrete pump (not shown) from a remote position along a line of pipe 22 into the intake opening 24 of the piping system 20 and through to the discharge opening 26 where it is discharged into the concrete pour area.

As shown, an inner arm section 28 of the arm structure 12 is cantilevered atop the base 14. Two substantially parallel, tubular bodies 30 of the inner arm section 28 are joined with a partial top plate 32 and a similar partial bottom plate 34. The tubular bodies 30 are formed and welded from aluminum sheet in rectangular cross-section and the plates 32,34, also formed of aluminum sheet, are welded thereto. The inner arm section 28 rests atop and is supported by a bearing adapter 36 and an underlying bearing 38. Four spaced, upright bayonets or posts (not shown) are formed on the bearing adapter 36 and the tubular bodies 30 are pinned thereto. The bearing 38 lies in a horizontal plane, and thus the inner arm section 28 is cantilevered atop the base 14 for 360° rotation about a vertical axis.

Figure 2:
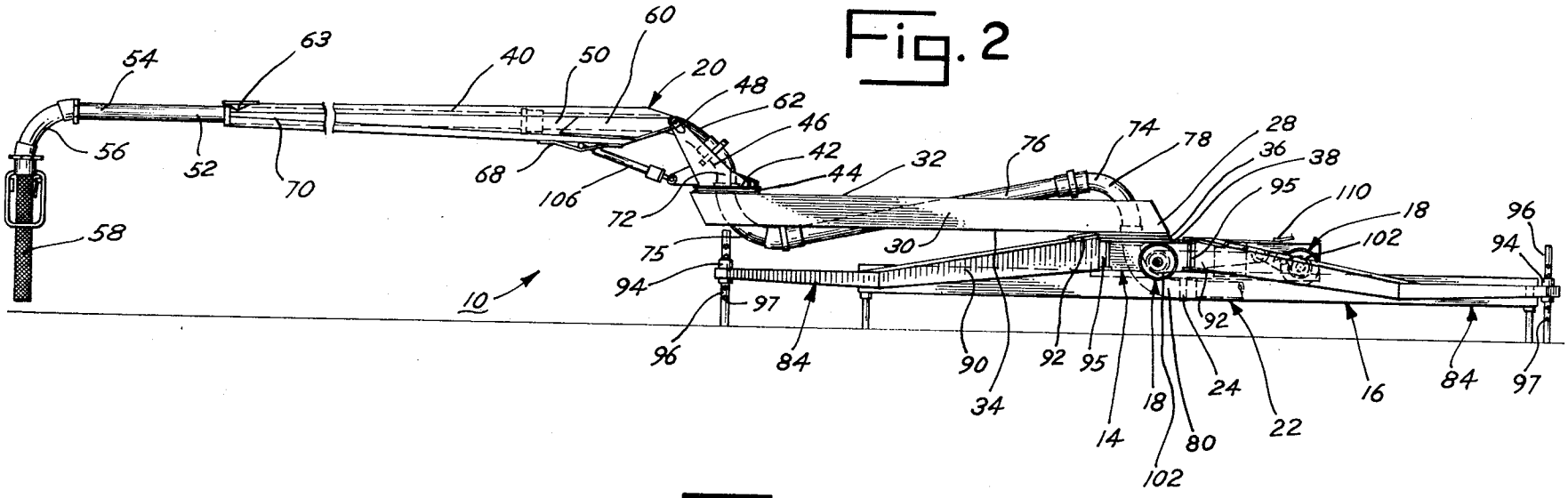
FIG. 2 is a side view of the preferred embodiment of FIG. 1.
Figure 3:
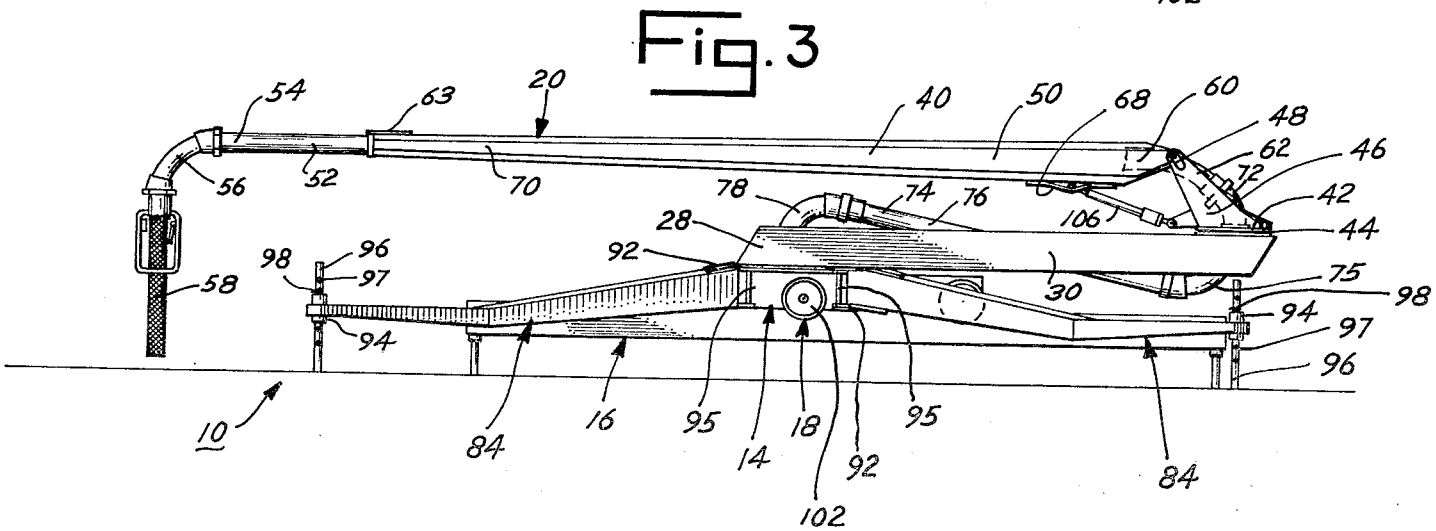
FIG. 3 is a view similar to FIG. 2 depicting the arm structure in position for transport.

Cantilevered atop the outer end of the inner arm section 28 is an outer arm section 40. As shown in FIG. 2, an arm support bracket 42 is mounted on a bearing 44 for 360° rotation about a vertical axis. Two spaced upright plates 46 extend above the bearing 44 to define pin receiving slots 48. Pinned thereto for angular elevation is an outer arm casing section 50. The outer arm section 40 is thus cantilevered atop the inner arm section 28 for rotation about a vertical axis and for angular elevation as well.

Casing section 50 is adapted to support and partially encase an outer arm piping section that includes a length of rigid pipe 52. At the outer end 54, length 52 is joined to a 90° pipe bend 56 that directs the flow of concrete mix downward through a first flexible hose 58 into the concrete pour area. At the inner end 60, length 52 is joined to a second flexible hose 62 which allows for angular elevation of the outer arm section 40.

Casing section 50 is formed of aluminum sheet, shaped in two elongated sections and welded together. Gussets are provided at 63, 64, 66 and 68. As shown, the casing section 50 tapers outward to an end 70 where it contacts the length of pipe 52. Beyond the end 70, pipe 52 is self-supporting.

Referring again to FIG. 2, the second flexible hose 62 is joined to a rigid pipe bend 72 that is supported by and rotates with the arm support bracket 42. Rotatably connected to the lower end of the pipe bend 72 is an inner arm piping section 74 that includes a pipe bend 75, a length of pipe 76 and a pipe bend 78. To reduce the sharpness of bends in the flow path of the concrete mix, the upper end of the pipe bend 78 extends above the level of the inner arm section 28, the lower end of the pipe bend 75 extends below that level, and the pipe 76 slants diagonally therebetween.

Connected to the lower end of the pipe bend 78, through the open center of the bearing 38, is a pipe bend 80. Joined thereto is the pipeline 22 through which the concrete mix is pumped by the concrete pump.

As stated, the arm structure 12 is mounted atop a base 14. As shown in FIG. 1, base 14 is generally rectangular. The arm structure 12 is mounted atop the base 14 adjacent one end thereof, and four extensible outriggers 84 are pinned to brackets 86 spaced equidistant about the arm structure 12. Mounted to the sides of the base through axles are four flanged wheels 88.

The outriggers 84, pinned for extension and retraction about vertical axes, include tubular outrigger bodies 90 formed of aluminum sheet. Bodies 90 are fastened to steel weldments 92 that are pinned to brackets 95. At its outer end, each outrigger body has attached thereto a vertical aluminum tube 94 through which a section of steel pipe 96 is mounted. Adjustment holes 97 are defined in the steel pipe 96 and in the tube 94 for loose fitting pins 98. The pipe 96 is lowered to contact the surface 100 by adjusting the pins 98 in holes 97.

The wheels 18 each consist of two flanges 102 welded to a hub 104. Each flange 102 is formed of aluminum plate pressed to a generally frusto-conical shape. The hub 104 is cut from aluminum tube. The flanges 102 are welded to the opposed open ends of the hub 104 in a back-to-back relationship.

The wheels 18 are adapted to roll along rails 16, which each have a flat top and outwardly slanted sides. As shown, the rails 16 may be connected to a rail spacer frame for ready transportation thereof. Alternatively, the rails 16 could be laid separately.

Operation of the swivel arm concrete placer 10 may be powered throughout or manual, as desired. As preferred, the angular elevation of the outer arm section 40 is powered by a hydraulic cylinder 106 attached between the outer arm section 40 and the arm support bracket 42. The rotation of the inner arm section 28 is powered by a swing motor 108 mounted on the base 14, and the travel of the base 14 along rails 16 is powered by a crawl motor (not shown) mounted on a crawl motor pad 110 atop the base 14. Remote controls are provided for all these drive components.

As detailed, the swivel arm concrete placer 10 is readily positioned for use in a concrete pour area. If a crane is available it may be crane lifted into the pour area. If necessary, however, it may be disassembled by unpinning the outriggers, the inner arm section and outer arm sections. When constructed of $\frac{1}{8}''$ and $\frac{1}{4}''$ aluminum sheet, with a base having a length of six feet, an inner boom section having a length of twelve feet and an outer boom section having a length of thirty feet, the swivel arm concrete placer has an overall weight of about 4,800 pounds. Further, the largest disassembled section weighs 400 pounds. Easy transport by a crew of four men is thus possible.

From the foregoing, it should be apparent to a person of ordinary skill in the art that changes or modifications could be made to the swivel arm concrete placer 10 as described in this Detailed Description of the Preferred Embodiment. The invention claimed should thus be measured by the appended claims, rather than the foregoing description. All equivalents which come within the scope of the claims are intended to be embraced therein.

What is claimed is:

1. A device for placing concrete mix from a pipe into a concrete pour area, said device comprising, in combination:

a traveling carrier member;

an arm structure and a first elongated arm member and a second elongated arm member, said first arm member mounted and pinned on said traveling carrier member for rotation about only a first vertical axis and having a free end, said second arm member having a free end and being mounted and pinned on said free end of said first arm member for rotation about a second vertical axis and pivotal movement about a horizontal axis;

means for piping said concrete from said pipe including a first piping section mounted on said carrier member a second piping section mounted on said arm member and connected to said first piping section for rotation with said first arm member, and a third piping section mounted on said second arm member and connected to said second piping section for rotation and pivoting movement with said second arm member, said third piping section having an open end at the free end of the second arm member for discharging said concrete mix; and means for stabilizing said carrier member and said arm structure, said means including four rigid, unitary and elongated outrigger members each mounted and pinned on said carrier member about joints having third vertical axes, said third vertical axes being vertical relative to said first and second vertical axes for supporting said carrier member;

whereby said device may be located in or adjacent said concrete pour area and said concrete mix may be accurately placed by rotating said first arm member, and rotating and pivoting said second arm member of said arm structure.

2. The device of claim 1 wherein said carrier member has wheels adapted for traveling upon rails.

3. The device of claim 1 including first drive means for driving the rotation of said first arm member.

4. The device of claim 1 including second drive means for driving the rotation and pivotal movement of said second arm member.

5. The device of claim 1 including means for releasably fastening said second arm member to said first arm member, means for releasably fastening said first arm member to said carrier member, means for releasably fastening said outrigger members to said carrier member, means for releasably fastening said third piping section to said second piping section, and means for releasably fastening said second piping section to said first piping section, whereby said device may be readily assembled and disassembled for transport.

6. Portable apparatus for transporting a semi-fluid concrete mass from a concrete pump to a concrete pour area said concrete pour area having therein a latticework of reinforcing steel rods, said apparatus comprising, in combination:

spaced, parallel and elongated rails, said rails being supported on said steel rods when said apparatus is in use; and a swivel arm concrete placer including, a carrier member having flanged wheels rotatably mounted thereon, said flanged wheels adapted for movement along said rails, an arm structure having a first elongated arm member and a second elongated arm member, said first arm member mounted and pinned on said carrier member for rotation about only a first vertical axis and having a free end, said second arm member having a free end and being mounted and pinned on said free end of said first arm member for rotation about a second vertical axis and pivotal movement about a horizontal axis, a first drive mechanism mounted on said carrier member for rotating said first arm member about said first vertical axis;

a second drive mechanism mounted on said first arm member for rotating said second arm member about said second vertical axis, a third drive mechanism mounted on said first arm member for pivoting said second arm member about said horizontal axis, four rigid, unitary and elongated outrigger members each pivotally mounted and pinned to said carrier member about joints having third vertical axes, said third vertical axes being vertical relative to said first and second vertical axes supported on said steel rods, pipe for piping said semi-fluid concrete mass from said concrete pump to said free end of said second arm member, said pipe including a first piping section mounted on said carrier member, a second piping section mounted on said first arm member and connected to said first piping section, a third piping section mounted on said second arm member and connected to said second piping section for rotation and pivoting movement with said second arm member, said third piping section having an open end for discharging said concrete mass at said free end of said second arm member; and control means connected to said swivel arm concrete placer for controlling said first drive mechanism, said second drive mechanism and said third drive mechanism.

* * * * *